US006460927B1

(12) United States Patent
Groth

(10) Patent No.: US 6,460,927 B1
(45) Date of Patent: Oct. 8, 2002

(54) SUPPORT ASSEMBLY FOR USE WITH WHEELCHAIR

(76) Inventor: Michael C. Groth, 12425 Knoll Rd., Elm Grove, WI (US) 53122

( * ) Notice: Subject to any disclaimer, the term of this patent is extended or adjusted under 35 U.S.C. 154(b) by 0 days.

(21) Appl. No.: 09/531,399

(22) Filed: Mar. 21, 2000

Related U.S. Application Data

(60) Provisional application No. 60/125,381, filed on Mar. 22, 1999.

(51) Int. Cl.[7] ..... A47C 3/025

(52) U.S. Cl. ..... 297/284.9; 297/410; 297/DIG. 4

(58) Field of Search ..... 297/DIG. 4, 396, 297/394, 410, 397, 406, 407, 486, 188.06, 391, 284.9, 219.1, 220, DIG. 10

(56) References Cited

U.S. PATENT DOCUMENTS 2,666,476 A * 1/1954 Lycan ..... 297/410
3,497,259 A * 2/1970 Sherfey ..... 297/391
3,730,589 A * 5/1973 Lane ..... 297/410 X
3,764,180 A * 10/1973 Mulholland ..... 297/410 X
4,073,537 A * 2/1978 Hammersburg ..... 297/384
4,971,393 A * 11/1990 Maisenhalder ..... 297/391 X
4,989,836 A * 2/1991 Hudson, III et al. ..... 297/391
5,362,082 A 11/1994 Kornberg
5,586,810 A * 12/1996 Liu ..... 297/410 X
5,967,613 A * 10/1999 McKeever ..... 297/397

* cited by examiner

*Primary Examiner*—Peter M. Cuomo
*Assistant Examiner*—Stephen Vu
(74) *Attorney, Agent, or Firm*—Joseph S. Heino

(57) ABSTRACT

A torso support assembly is adapted to be mounted to the back of the frame of a wheelchair. The assembly includes a longitudinally extending support tube which is removably attachable to the back of the wheelchair. Integral to the tube and located at each end of it is a quick release locking mechanism. At the ends of the support tube, and insertable within the ends of the support tube, is a pair of support rod members. Each support rod member is rotatable within its respective end of the support tube. Each support rod member is engagable with the quick release mechanism at one end and is fixably attached to a support arm at the other end. Each support arm includes a forwardly extending pad support member. At the end of each support member is mounted a pad member. Each pad member is limitedly rotatable about the pad support member such that its position is adjustable. Each pad member is movable inwardly and outwardly of the pad support member. Each pad member can be constructed or configured in a variety of shapes depending upon the support which is desired or required. Each pad support member and pad member can be quickly, easily and independently adjustable upwardly, outwardly, and forwardly relative to the torso of the wheelchair occupant.

13 Claims, 1 Drawing Sheet

SUPPORT ASSEMBLY FOR USE WITH WHEELCHAIR

This Application claims the benefit of U.S. Provisional Application No. 60/125,381, filed Mar. 22, 1999.

FIELD OF THE INVENTION

This invention relates generally to wheelchairs and to accessory items for use with wheelchairs. More particularly, it relates to an accessory apparatus which is intended to aid in the lateral support of the torso area, including ribs and shoulders, of a person seated and situated within a wheelchair.

BACKGROUND OF THE INVENTION

It has long been recognized that persons who need to be ambulated with the assistance of a wheelchair very often also need to be provided with additional torso support within the wheelchair itself For example, persons who have postural problems due to spine weakness or spine deformity often need to have auxiliary torso support, via rib and/or shoulder support, so that they can sit both safely and comfortably in an upright position within the wheelchair. One such device which provides this type of support is disclosed by Kornberg in U.S. Pat. No. 5,362,082. In the experience of this inventor, however, such devices often have limitations in the types of wheelchairs they can be attached to and in the way that they can be used. For example, one wheelchair user may require lateral low back support in one direction and lateral upper back support in the opposite direction due to his or her scoliotic condition. This would mean that a torso support member would need to be closer to center on one side of the occupant's spine and the opposite support member would need to be higher or lower than the other and further from center to the other side of his or her spine. The next user of the same chair may require just the opposite arrangement for support. Yet another wheelchair occupant may have the same spinal deformity but require wider girth adjustment due to his or her larger frame or size. Still another may need to be supported by his or her ribs on one side and by his or her shoulder on the other. In short, the adjustments that may be required or desired are as many and as varied as the persons who require or desire to use such wheelchairs.

SUMMARY OF THE INVENTION

It is, therefore, a principal object of this invention to provide a new, useful and uncomplicated apparatus for providing lateral torso support of a wheelchair user. It is a further object of this invention to provide such an apparatus which requires only a minimal number of elements and which requires only a minimal number of steps to utilize. It is yet another object of this invention to provide such an apparatus which can be readily used by a wide variety of wheelchair occupants having upper torso weakness or spinal deformities of almost every kind and nature. It is still another object of this invention to provide such an apparatus which is readily and quickly adjustable so as to quickly and easily accommodate the many sizes and shapes of persons who may need to be seated within the wheelchair itself. It is still another object of this invention to provide such an apparatus which may be variably used to apply support to the wheelchair occupant's rib cage area and/or to his or her shoulder area.

The present invention has obtained these objects. It provides for a first support member which is functionally adapted to be mounted to the back of the frame of a typical wheelchair. This first support member includes a longitudinally extending support tube which is removably attachable to the back of the wheelchair. Integral to the tube and located at each of its ends is a quick release locking mechanism. Also located at the ends of the support tube, and insertable within the ends of the support tube, is a pair of complimentary support rod members. Each support rod member is slidable within its corresponding end of the support tube. Additionally, each support rod member is rotatable within that end of the support tube. Each support rod member is engagable with the quick release mechanism at one end and fixably attached to a support arm at the other. Each support arm includes a forwardly extending pad support member at the end of which is mounted a pad member. Each pad member is limitedly rotatable about the pad support member and movable inwardly and outwardly of the support member such that its position may be adjustable about the pad support member. Each pad member can be constructed or configured in a variety of shapes depending upon the support which is desired or required. With this configuration, each pad support member and pad member can be quickly, easily and independently adjustable upwardly and outwardly relative to the torso of the wheelchair occupant. The foregoing and other features of the device of the present invention will be further apparent from the description which follows.

DETAILED DESCRIPTION

Figure 1:
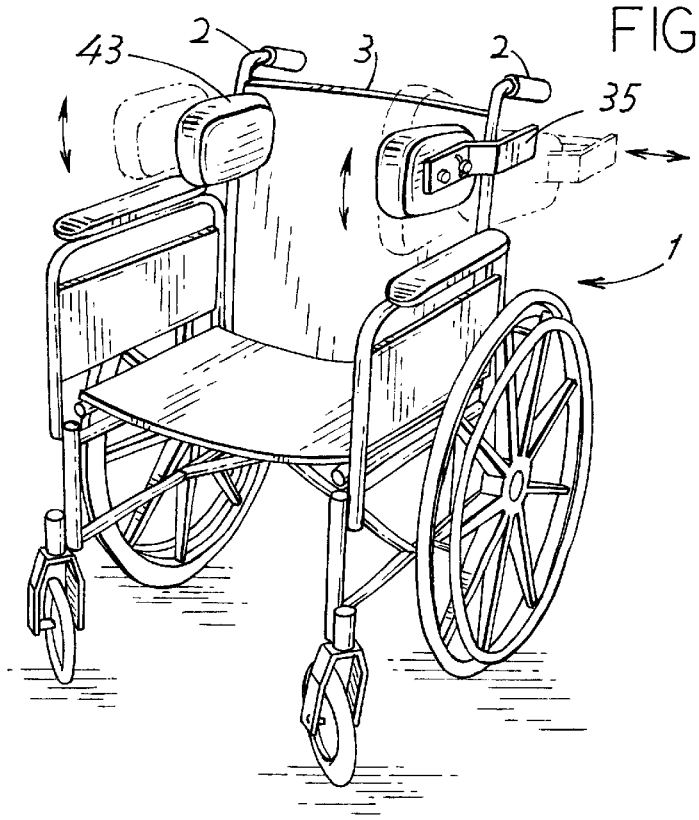
FIG. 1 is a front perspective view of the support assembly of the present invention as it is used with a typical wheelchair.

Referring now to the drawings in detail, FIG. 1 shows a support generally identified 10, constructed in accordance with the present invention. As shown, the support assembly 10 is attached to the back side of the wheelchair 1 by using the two main vertical support menbers 2 to either side of the back.

Figure 2:
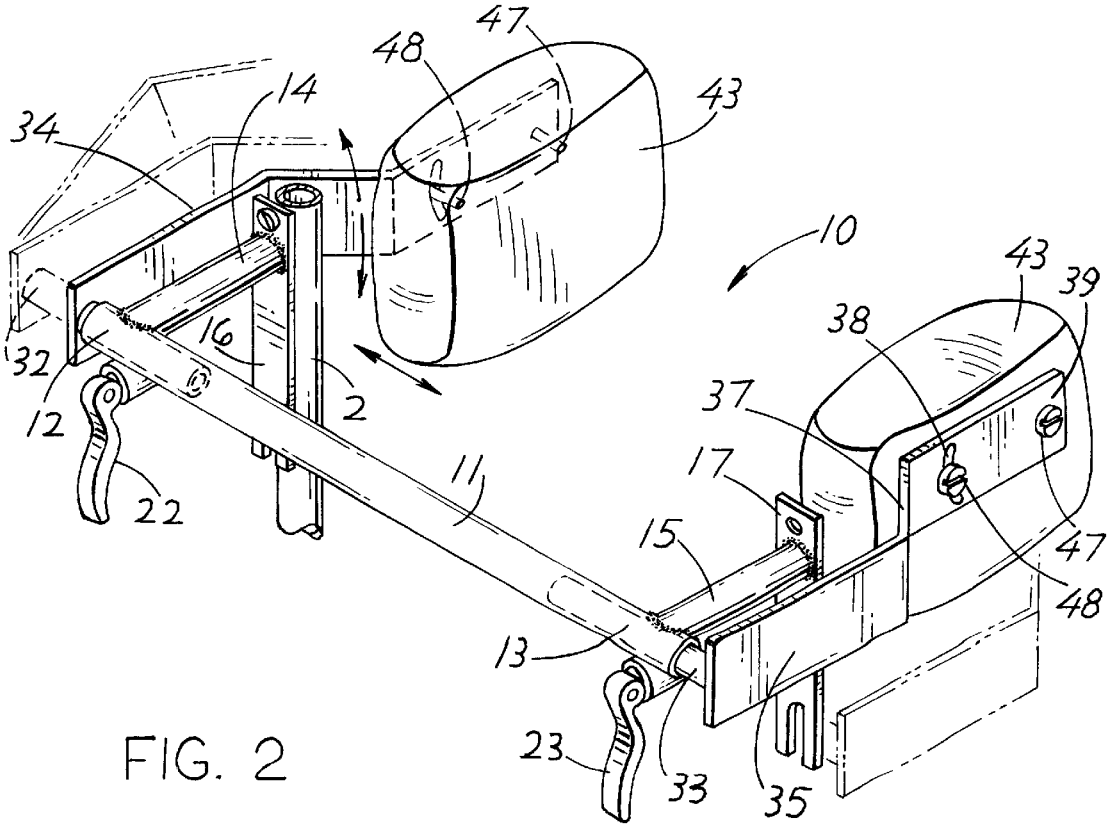
FIG. 2 is an enlarged rear perspective view of the support assembly shown in FIG. 1 and showing, in phantom view, the positions achievable with the assembly.

The preferred embodiment of the support assembly 10 of the present invention includes a frame tube 11 which extends in a horizontal position relative to the back side of the wheelchair 1. See FIG. 2. Extending forwardly from each end 12, 13 of the frame tube 11 is a frame extension member 14, 15, respectively. Nearest each of the wheelchair support members 2 is a frame chair support plate 16, 17 each of which is attachable to one of the wheelchair support members 2. Each support plate 16, 17 is configured with an attachment slot at the bottom of the plate 16, 17 and with a support hole at the top of the plate 16, 17. Each of the slots and holes of the plates 16, 17 is functionally adapted to receive a fastening bolt therethrough.

The preferred embodiment of the support assembly 10 of the present invention also includes, at each end 12, 13 of the horizontal frame tube 11, a trunk frame member 34, 35, respectively. Each trunk frame member 34, 35 is a mirror-image of the other for reasons which will become more apparent later in this detailed description. Each trunk frame member 34,35 includes a trunk frame rod member 32, 33, respectively. The trunk frame rod 33 of the right-sided trunk frame member 35 (as viewed from the rear of the wheelchair, or from the wheelchair occupant's point of reference) is functionally adapted to be slidably engageable with the right-sided end 13 of the frame tube 11. The same is true of the trunk frame rod 32 of the left-sided frame member 34 in relation to the left-sided end 12 of the frame tube 11. In this fashion, the trunk frame rod 33 of the right-sided trunk frame member 35 is freely rotatable within the right-sided end 13 of the frame tube 11. And, the same is true of the trunk frame rod 32 of the left-sided member in relation to the left-sided end 12 of the frame tube 11. This allows movement in to and out of the tube ends 12, 13. It also allows for full rotation of the trunk frames 34, 35 about the frame tube 11. This important feature allows virtually infinite adjustments of the trunk frames 34, 35 to be made in relation to the size and frame of the user or occupant of the wheelchair 1. Each of the ends 12, 13 of the frame tube 11 is constructed with a toggle assembly 22, 23, or quick release lock mechanism, respectively. The toggle assemblies 22, 23 allow the trunk frame rods 32, 33 to be quickly and readily fixable within the frame tube ends 12, 13 for ease in positioning and securing the trunk frames 34, 35 relative to the postural and positional requirements of the wheelchair occupant.

Extending forwardly of the wheel chair 1, the trunk frame 35 of the preferred embodiment also includes an inwardly bent truck frame middle portion 37 and a forwardly bent trucnk frame distal portion 39. In this fashion, the trunk frame 35 extend forwardly from the frame tube 11, around the vertically extending wheel chair support menber 2 and into a position where it can engage the trunk, or a portion thereof, or the shoulder of the wheelchair occupant. Removably attached to the distal portion 39 of the right-side trunk frame 35 is a trunk pad 43. Although shown as a somewhat rectangular box, it is to be understood that trunk pad 43 of the present invention need not assume any particular shape. In the experience of this invnentor, the shape of the trunk pad 43 can be made in virtually any number of shapes. For example, the trunk pad 43 cvould asume, and does assume in alternative embodiments (not shown), a semicircular shape which aids in the frontal support of the wheelchair occupant. In short, the trunk pad 43 can be configured in almost any shape depending upon what is desire or required. Such shape, however, is not a limitation of this assembly 10. It should also be noted that the trunk pad 43 is constructed such that it can be rotated about a vertical plane in relation to the trunk frame menber 35. This is accomplished by security the forward portion of the pad 43 to the distal trunk frame 39 with a bolt or screw 47 about which the pad 43 can rotate. To the rear of the pad 43, a second bolt or screw 48 is located and which can move through a semicircular opening 38 located within the distal trunk frame 39. The trunk pad 43 is also movable along the frame 39 by virtue of a plurality of holes defined within the trunk pad 43 for receiving the bolts or screws 47, 48. In this fashion, the trunk pad 43 can be comfortable retained in almost constant horizontal position regardless of the angle at which the trunk frame 35 presents relative to the horizontal.

In application, the wheelchair occupant is situated within the chair 1 with it his or her back adjacent the back portion 3 of the chair 1. Depending upon the physical stature of the occupant, and depending upon what lateral support is desired or required, the toggle assemblies 22, 23 are actuated such that the trunk frame rods 32, 33, respectively, are freely rotatable and positionable within the frame tube ends 12, 13. For purposes of explanation, it will be assumed that the lateral support is for a gentleman of average height and weight having a need to be laterally supported at his left ribs and right shoulder. With the occupant seated, the left trunk pad 43 is comfortably positioned beneath the occupant's left armpit area. The trunk frame rod 32 is gently urged inwardly of the tube end 12 to the point desired. Once positioned, the left toggle assembly 22 is actuated to effectively lock the frame rod 32 in position. The right trunk frame 35 is then pulled outwardly of the frame tube 11 sufficiently to allow the trunk pad 43 to clear the shoulder of the occupant. The right trunk frame 35 is then rotated about the frame tube 11 in an upward position such that the pad 43 is at the same height as the occupant's shoulder. The right trunk pad 43 is then similarly and comfortably positioned at the occupant's right shoulder. The right toggle assembly 23 is then actuated to effectively lock the frame rod 33 in position. To change positions, it is a relatively simple matter of unlocking the toggle assemblies 22, 23 and repositioning each of the trunk frames 34, 35 relative to the wheelchair occupant and his or her chest or shoulders depending upon what is desired or required.

From the foregoing detailed description of the illustrative embodiment of the invention set forth herein, it will be apparent that there has been provided a new, useful and uncomplicated apparatus for providing lateral torso support of a wheelchair occupant; which requires only a minimal number of elements and which requires only a minimal number of steps to utilize; which can be readily used by a wide variety of wheelchair occupants having upper torso weakness or spinal deformities of almost every kind and nature; and which is readily and quickly adjustable so as to quickly and easily accommodate the many sizes and shapes of persons who may need to be seated within the wheelchair itself.

The principles of this invention having been fully explained in connection with the foregoing, I hereby claim as my invention:

1. As A torso support mechanism which is removably attachable to an upright portion of a wheelchair seat for stabilizing the torso of a wheelchair occupant, said mechanism comprises;

a longitudinally extending support tube, said support tube having a first end and a second end, means for attaching the support tube to the back of the upright portion of the wheelchair, a pair of independently movable support rods, one support rod being slidably and rotatably receivable within the first end of said support tube and the other support rod being slidably and rotatably receivable within the second end of said support tube, means for releasably securing the support rods within the support tube, a pair of torso support members, each of said torso support members being attached to a support rod and each of said torso support members further being adjustable upwardly and outwardly relative to the torso of the wheelchair occupant and including a torso support pad.

2. The torso support mechanism of claim 1 wherein each torso support pad is movable relative to the torso support member. relative to the torso support member.

3. The torso support mechanism of claim 2 including means for providing plurality of varied shaped and sized torso pads.

4. A torso support torso mechanism which is attachable to the back of an upright portion of a wheelchair seat for stabilizing the torso of a wheelchair occupant, said mechanism comprises:

a longitudinally extending support tube, said support tube having a first end and a second end, means for attaching the support tube to he back of the upright portion of the wheelchair, a first support rod member, said first support rod member having a proximal end and a distal end, the distal end of said first support rod member being slidably and rotatably receivable within the first end of said support tube, means for releasably securing the distal end of said first support rod member within said support tube first end, a second support rod member, said second support rod member having a proximal end and a distal end, the distal end of said first support rod member being slidably and rotatably receivable within the first end of said support tube, means for releasably securing the distal end of said second support rod member within said support tube second end, a first torso support pad member, said first torso support pad member being attached to the proximal end of said first support rod member and further being movable relative to the proximal end of the first support rod member whereby the first torso support pad member is adjustable upwardly and outwardly relative to the torso of the wheelchair occupant, and a second torso support pad member, said second torso support pad member being attached to the proximal end of said second support rod member and further being movable relative to the proximal end of the second support rod member whereby the second torso support pad member is adjustable upwardly and outwardly relative to the torso of the wheelchair occupant, and means for providing a plurality of varied shaped and sized torso pads to said first and second torso support pad members.

5. A torso support mechanism for a wheelchair with an upright back portion comprising:

a generally cylindrical shaped hollow frame tube attached generally horizontally behind the wheelchair upright back portion, said frame tube having a first end and a second end, a first trunk frame rod having a proximal end and a distal end, said proximal end sliding into the first end of the hollow frame tube, a second trunk frame rod having a proximal end and a distal end, said proximal end sliding in the second end of the hollow frame tube, a first forwardly extending trunk frame having a proximal end attached to the distal end of the first frame rod, a middle portion angled inwardly towards the wheelchair and a distal portion generally parallel to the proximal end, a second forwardly extending forwardly extending trunk frame having a proximal end attached to the distal end of the first trunk frame rod, a middle portion angled inwardly towards the wheelchair and a distal portion generally parallel to the proximal end, a means for selectively allowing and preventing rotation and translation of the first trunk frame rod within the frame tube, a means for selectively allowing and preventing rotation and translation of the second trunk frame rod within the frame tube, and a trunk pad attached to each distal end of the trunk frames.

6. The torso support mechanism of claim 5 wherein the means for selectively allowing and preventing rotation and translation comprises a toggle assembly such that, when the toggle is in the closed position, it provides pressure on the trunk frame whereby the trunk frame is unable to rotate or translate within the frame tube.

7. The torso support mechanism of claim 6 wherein the pads are rotatable.

8. The torso support mechanism of claim 7 wherein the trunk pads slide along the trunk frame.

9. The torso support mechanism of claim 8 wherein at least one of said trunk pads is positioned against the shoulder area of the wheelchair occupant.

10. The torso support mechanism of claim 8 where both said trunk pads are positioned such that one of said pads is positioned against one shoulder and the other pad is positioned against the other shoulder of the wheelchair occupant.

11. The torso support mechanism of claim 8 wherein at least one of said trunk pads is positioned against the chest or armpit area of the wheelchair occupant.

12. The torso support mechanism of claim 8 wherein both said trunk pads are positioned such that one of said pads is positioned against one armpit area and the other pad is positioned against the other armpit area of the wheelchair occupant.

13. The torso support mechanism of claim 8 wherein one of said trunk pads is positioned against the wheelchair occupant's one chest or armpit area and the other pad is positioned against the opposing shoulder of the wheelchair occupant.

* * * * *